United States Patent [19]

McIntosh et al.

[11] 4,148,970

[45] Apr. 10, 1979

[54] LUBRICATING COMPOSITION APPLIED OVER PRIMER COAT

[75] Inventors: George A. McIntosh, North Madison, Ohio; Russell Smith, Tinton Falls, N.J.

[73] Assignee: Diamond Shamrock Corporation, Cleveland, Ohio

[21] Appl. No.: 865,986

[22] Filed: Dec. 30, 1977

[51] Int. Cl.[2] ..... B21B 45/02; C10M 7/24; C10M 7/02; C10M 7/08

[52] U.S. Cl. ..... 428/469; 72/42; 72/46; 148/6.15 Z; 148/6.16; 148/6.2; 148/31.5; 252/18; 252/25; 252/49.5; 428/472

[58] Field of Search ..... 72/42, 46; 252/17, 18, 252/25, 49.5; 148/6.16, 6.2, 6.15 Z, 31.5; 428/469, 472

[56] References Cited

U.S. PATENT DOCUMENTS

| | | | |
|---|---|---|---|
| 2,697,072 | 12/1954 | Roden | 252/18 |
| 2,760,931 | 8/1956 | Spring et al. | 252/17 |
| 3,282,843 | 11/1966 | Alburger | 252/49.5 X |
| 3,313,728 | 4/1967 | Glasson et al. | 252/18 |
| 3,377,278 | 4/1968 | Ruzza | 252/23 |
| 3,664,953 | 5/1972 | Wright | 252/25 X |
| 3,725,274 | 4/1973 | Oruzzo | 252/18 |
| 3,948,686 | 4/1976 | Lochner et al. | 148/6.15 R |

*Primary Examiner*—Harold Ansher
*Attorney, Agent, or Firm*—John J. Freer

[57] ABSTRACT

Since primers can be applied to metal substrates prior to subsequent operation, including metal deformation, they are often applied in coil coating operation. The potential for the removal of primer coating during metal deformation is a drawback to early coating application. There is now provided a lubricant composition particularly adapted to meet this problem. The composition comprises metallic stearate, emulsifier, titanium dioxide and Xanthomonas hydrophilic colloid, all in aqueous medium.

16 Claims, No Drawings

LUBRICATING COMPOSITION APPLIED OVER PRIMER COAT

BACKGROUND OF THE INVENTION

Primers are typically coated over metal substrates to provide at least some corrosion protection. They may be applied directly to the substrate, but quite often are applied over a previously treated surface. For example, U.S. Pat. No. 3,671,331 teaches the application of a weldable primer over a metal substrate first coated with special hexavalent-chromium-containing composition.

The primers can often be applied as mill finishes, such as directly in a coil coating operation. Subsequent metal operation can include stamping and drawing, subjecting the coating to a severe shear force. A test for primer adhesion subjected to shear force has been discussed, for example, in U.S. Pat. No. 3,954,510. Therein it is noted that quite good primer adhesion can be obtained, particularly from careful control in the make-up of the composition of a pre-treatment formulation.

Where the primer coating is a zinc dust primer, it has been proposed in U.S. Pat. No. 3,948,686 to lubricate the coating, prior to metal deformation, with a film composed of a resinous polymeric binder plus a lubricating substance such as a wax, fat, graphite or oil. The film is typically baked on. It would, however, be desirable to apply a lubricant film that, after service, could be easily removed.

SUMMARY OF THE INVENTION

A lubricant is now provided that will maintain consistency of excellent coating adhesion. Further, in addition to lubrication, the composition also provides excellent die maintenance. The lubricating composition shows desirable stability including freedom from settling, layering or gumming. Moreover, it is readily applied by conventional techniques and has been found to provide ease of clean-up after application and metal deformation. When applied to substrates such as one side primer coated coil steel, the composition can provide desirable corrosion resistance to the bare steel.

Broadly, the present invention is a lubricant composition, particularly adapted for application to a primer coating on a metal substrate. The composition comprises metallic stearate, emulsifier, titanium dioxide and Xanthomonas hydrophilic colloid, all in aqueous medium.

In another aspect, the invention relates to a coated metal substrate ready for subsequent metal deformation. In a still further aspect, the invention relates to a process for deforming a coated metal while enhancing coating adhesion in said processing.

DESCRIPTION OF THE PREFERRED EMBODIMENTS

The lubricating composition will include a metallic stearate as an essential component. The metallic portion of the stearate will preferably be supplied by zinc, calcium or their mixtures, although other metallic stearates, e.g., cadmium stearate, magnesium stearate, barium stearate and the like are contemplated for use in minor amount. The commercially available substances have been found to be suitable. Thus, although an essentially pure zinc stearate, for example, will be useful, such substance can be supplied by the products derived from commercially available stearic acid. It is convenient, for handling and storage to prepare the composition as a lubricant concentrate. This concentrate will then typically be blended, prior to use, with aqueous medium, as discussed more fully hereinbelow. The metallic stearate will typically provide up to about 25 weight percent of the lubricant concentrate, although as little as about 1 weight percent may be present. Advantageously, for efficient lubrication plus economy, the concentrate will contain between about 5–20 weight percent of metallic stearate.

The metallic stearate may first be preblended with emulsifier, and the resultant preblend then used to make the concentrate. For enhanced dispersion of concentrate ingredients, it is preferred that this emulsifier be a synthetic substance typically derived from fatty acids. The polyglycol esters have been found to be suitable, particularly those having an HLB number with the range from about 10 to about 12. Specifically useful emulsifiers include the polyethylene glycol oleates. The lubricant concentrate will typically contain between about 0.5 to as much as about 12 weight percent or more of the emulsifier. Usually between about 2–6 weight percent will be present in the concentrate with the amount generally being directly proportional to the amount of metallic stearate, so that the greater amounts of emulsifier will be used with greater amounts of such stearate.

The titanium dioxide will generally be supplied simply by an titanium dioxide pigment that is useful in the paint art. The pigment should be in such condition that it will readily disperse in water. Advantageously, the titanium dioxide will be less than about 200 mesh (U.S. Sieve series) and generally finer than 325 mesh. In the concentrate, the titanium dioxide component can provide from about 0.5 to about 10 weight percent of the concentrate weight, although an amount of about 1 to 6 weight percent is preferred for efficient lubrication and economy. Although the titanium dioxide will almost always be supplied totally by titanium dioxide, it is contemplated that a quite minor amount, e.g., less than 15 weight percent of the titanium dioxide, might be replaced and provided by other lubricating pigments such as barium carbonate.

In addition to the water for the aqueous medium of the concentrate, the other key ingredient for the lubricant concentrate is the Xamthomonas hydrophilic colloid. This ingredient will be supplied most always by substance known commercially simply as "xanthan gum." This term may be used herein for convenience; further, it may also be termed a heteropolysaccharide, or carbohydrate, as they can be produced by the fermentation of a carbohydrate, for example by the bacterium *Xanthomonas campestris.* Such xanthan gum hydrophilic colloids are complex in nature and have high molecular weight, e.g., more than one million is typical. Such substance is generally available in powder form that exhibits ready solubility in water. The use of the xanthan gum hydrophilic colloid in water, even in very minor amounts, exhibits excellent suspending property. Thus, although greater amounts may be used a 1% solution of the xanthan gum hydrophilic colloid will support a 10 weight percent blend of a very finely divided silica sand for several days; this suspending power is ostensibly independent of suspension pH. The preparation of the xanthan gum hydrophilic colloids, and most particularly from the bacterium *Xanthomonas campestris,* has been extensively discussed, for example in U.S. Pat. No. 3,659,026, and solution characteristics in water for such hydrophilic colloid are also discussed in that patent.

The compatability of these xanthan gum hydrophilic colloids with additional water-soluble thickening polymers can result in useful blends. These may also be used as the colloid component in the lubricant concentrate so long as the xanthan gum forms the major amount, and advantageously contributes at least 60 weight percent to the blend of gums. For example, in the above mentioned U.S. Pat. No. 3,659,026, a particularly useful blend has been taught that includes the xanthan gum along with locust bean gum. Preferably, for economy and enhanced solution viscosity, such blends contain between about 60–95 weight percent of the xanthan gum. Additional water-soluble thickening polymers which exhibit compatibility with the xanthan gum include other natural gum thickeners such as guar gum, karaya gum and tragacanth gum, water-soluble cellulose ethers including those of hydroxyethylcellulose, methylcellulose and methylethylcellulose, with other such polymers including starches, e.g., corn starch, and dextrins, alginates and carageenan as well as the compatible mixtures thereof.

The Xanthomonas hydrophilic colloid will provide efficient lubricant composition storage stability when present in even very minor amount, e.g., on the order of about 0.1–0.2 weight percent of the lubricant concentrate. On the other hand, only about 4 weight percent of the colloid in water will yield a viscous solution typically having a Brookfield viscosity on the order of about 20,000. Thus it is contemplated to generally use the colloid in the concentrate in an amount providing from about 0.5 to about 2 weight percent of colloid in the lubricant composition.

It is usually recommended that if the xanthan gum is in aqueous medium and is to be stored for a period longer than about a day or so, that a preservative likewise be present. Such preservative will typically resist or retard microbial growth in the solution. It is therefore recommended that such a preservative be present in the compositions of the present invention which are to be stored. A variety of well known preservative substances can be used. These include formaldehyde, neutral esters of parahydroxybenzoate, sodium pentachlorophenate methyl p-hydroxybenzoate and sodium o-phenylphenate tetrahydrate. Although the preservative might be present in an amount of as much as about 1 to 2 weight percent or so of the concentrate composition, it is typically present in very minor amounts, e.g., as little as about 0.01–0.5 weight percent.

Before use, the lubricant concentrate will typically be added to aqueous medium, which for economy is simply water. The weight ratio of the aqueous medium to the concentrate will generally be on the order of 2:1 to 20:1 with the particular ratio being selected in accordance with the degree of the metal deformation contemplated. Thus, the lower ratios on the order of 2–4:1 will most suitably be employed where the surface of the coated stock will be subjected to the most severe deformation.

The lubricant concentrate, or the fully diluted lubricant composition, will most always contain additional substances, e.g., wetting agent which is preferably nonionic. The wetting agent should also have low foaming tendency. The alkoxylated alkyl phenols have been found to be quite serviceable. Such can be present in an amount of as little as about 0.01 weight percent or as much as about 1 weight percent, both basis weight of the concentrate. It can also be useful to include a substance that will facilitate corrosion resistance for the lubricant composition applied to a metal substrate. Thus, the lubricant concentrate will generally contain one or more ingredients typically employed in the metal coating art for imparting some corrosion resistance or enhancement in corrosion resistance for metal surfaces. Such materials include nitrite salts, various chromates, e.g., strontium chromate, molybdates, vanadates, organic acids such as succinic acid and polyacrylic acid, zinc and magnesium salts not specifically hereinbefore mentioned such as zinc chloride and magnesium chloride as well as mixtures of the foregoing. Sodium nitrite is preferred for efficiency and economy. When used, these corrosion inhibiting materials are most usually employed in the concentrate in an amount totaling less than about 2 weight percent. Such the Xanthomonas hydrophilic colloid has usually broad compatiblity with a great variety of salts, acids or alkaline materials, it is contemplated to use any of such materials. Such compatability will be demonstrated by freedom from gellation, or from precipitate formation in the Xanthomonos hydrophilic colloid solution, as well as freedom from significant change in viscosity or flow properties after preparation of the lubricant composition but before use. Other additional ingredients may be present in very minor amounts. Thus, substances such as mineral oil, vegetable oil, silicone or petroleum oils or waxes, which are preferably excluded may be present in a total of less than about 1–2 weight percent, basis total weight of the concentrate.

The lubricant composition will typically be used at room temperature although it can be employed in heated condition. It can be applied by any of the techniques used for lubrication such as spraying, immersion, brush or roll coating. After such operation, the lubricated stock is ready for deformation although the stock can be set aside to permit drying of the lubricant composition before working. The concentration of the applied composition will depend principally upon the dilution of the lubricant concentrate with the aqueous medium. Although the lubricating composition will have desirable serviceability to metal stock, e.g., galvanized steel, when applied directly thereto, it is principally useful for application over a coated metal substrate.

Where the coated substrate is a coated coil of steel, for example, it may be coated on one side only. It may then be desirable to apply the lubricant composition to the uncoated as well as the coated side. One aspect of the coating composition is that it exhibits good adhesion to bare steel, without run-off, and will typically dry to an adherent film resistant to removal during handling and storage of the metal. Thus, where the composition contains a corrosion inhibiting material, the bare metal portion of the substrate that is coated with the lubricant composition will be provided with highly desirable corrosion resistance. After subsequent operation such as metal punching or pressing, the lubricant composition can be easily removed from both bare steel and the coated steel, such as either warm water and brushing, thus facilitating subsequent coating operation on the bare steel side.

The coated metal substrate, for which example might be coil steel, may have a primer coat that has been applied over a pre-paint coating on the metal surface. In U.S. Pat. No. 3,687,739 there is disclosed the application of a primer coat over an undercoat derived from a composition containing chromic acid and pulverulent metal as key ingredients. There has been shown, as in U.S. Pat. No. 3,948,686, the topcoating of an iron phosphate precoat, for example, with a zinc dust primer cost.

Although the nature of the primer coat is very broad in contemplation, is will contain finely divided pulverulent material. For example, U.S. Pat. No. 3,671,331 discusses primers containing a particulate, electrically conductive pigment, as does U.S. Pat. No. 3,687,739. Such primer coats, which are representative of those that contain pulverulent metal, are often for convenience referred to as "weldable primers." These primers contain an electrically conductive pigment plus a binder in a vehicle. Thus, it has been disclosed in U.S. Pat. No. 3,110,691 that a suitable zinc base paint composition for application to a metallic surface prior to welding can be prepared where key ingredients include not only the particulate zinc but also a liquid vehicle including a resinous film forming binder such as epoxy resin. Likewise, U.S. Pat. No. 3,118,048 shows a coating composition, that may be applied prior to welding, and has as chief ingredients a solvent forming at least a portion of the liquid vehicle and further containing a synthetic resin film-forming, or binder, component, for which modified alkyd resins are exemplary. In general, the particulate electrically conductive pigments in the weldable primers are aluminum, copper, cadmium, steel, carbon, zinc or magnetite, i.e., the magnetic oxide of iron. Also, the binder components may include polystyrene, chlorinated or isomerized rubber, polyvinyl acetate and polyvinyl chloride-polyvinyl acetate copolymers, alkyd/melamine, and epoxy esters.

The primer coat will be present on the metal substrate in a thickness of at least 0:1 mil.

A primer coat formulation applicable to metal substrates, without weldability in mind, can contain particulate zinc along with zinc oxide. Such paints are often formulated with a zinc dust to zinc oxide ratio of about 4:1, although such ratio may be as high as 9:1. Total pigment concentrations will vary considerably and are typically dependent upon the ratio of the zinc to the zinc oxide. Also, the ingredients in the formulation will typically be dependent upon the zinc to zinc oxide ratio. For example, where such ratio is 4:1 the vehicle usually employed is linseed oil or other oleoresinous medium. At ratios greater than 4 to 1, and with pigment concentrations ranging up to 90 to 95 percent, such compositions typically include polystyrene plasticized with chlorinated diphenyls.

Another primer coating system of interest has been referred to in the prior art, most ostensibly for convenience, as "silicate coatings." These appear to be aqueous systems that contain a finely divided metal such as powdered zinc or aluminum, lead, titanium or iron plus a water soluble or water dispersible binder. Representative of the binders are alkali metal silicates, an organic silicate ester, or a colloidal silica sol. Thus, U.S. Pat. No. 3,372,038 shows an aqueous coating system for providing corrosion resistance to metal substrates with a formulation containing a finely divided zinc powder plus an organic ammonium silicate. Although such silicate coatings are not typically employed before welding. U.S. Pat. No. 3,469,071 discloses arc-welding of a steel having a protective coating that may be derived from a coating composition containing inert silicate fillers, zinc powder and partically hydrolized esters of amphoteric metal binders, for example ethyl silicate. In U.S. Pat. No. 2,944,919 an aqueous based coating composition that contains a sodium silicate may further contain a finely divided metal in addition to zinc, such as magnesium, aluminum, manganese and titanium.

In addition to the above mentioned pulverulent substances, the pulverulent material providing the particulate substance can be one or more of titantium dioxide, colloidal silica, aluminum oxide, silicon dioxide, ferric oxide, nickel oxide, manganese dioxide, chromic oxide, chromic fluoride, calcium silicate, aluminum silicate, magnesium silicate, silicon carbide, ferric phosphate, calcium sulfite, barium sulfite, calcium sulfate, barium sulfate, carbon black, clay, including, for example, kaolinite and montmorillonite, sand, talc, mica, Wollastonite, Fuller's earth, diatomaceous earth, and mixtures thereof.

The following examples shows a way in which the invention has been practiced but should not be construed as limiting the invention. In the example all parts are parts by weight unless otherwise specified.

EXAMPLE

To a mixer there is charged 79 parts water, 0.23 part sodium nitrite, 0.05 part ethoxylated propoxylated alkylphenol having a viscosity in centipoises at 25° C. of 180 and a density at 25° C. of 8.7 lbs. per gallon, and 3.45 parts of polyethylene glycol 400 mono oleate. As these ingredients are being mixed under vigorous agtitation, there is next added to the mixture 1.09 part of xanthan gum hydrophilic colloid, which is heteropolysaccharide prepared from the bacteria specie *Xanthomonas campestris* and having a molecular weight in excess of 200,000. To this resulting mixture, as mixing continues, there is then added 1.28 part formaldehyde, 13.07 parts zinc stearate and 1.83 parts of pigmentary titanium dioxide. Mixing is continued until a thick mixture results.

A portion of this thick mixture is then diluted with deionized water in a weight ratio of 1 part of mixture to 7 parts of water. The resulting die lubricant is readily flowable. Steel test panels, which are cold rolled low carbon steel panels, are then coated with lubricant applied with an open cell urethane foam paint brush. Panels are thereafter removed from the lubricant and air dried.

An additional set of steel panels are similarly coated with a comparative lubricant composition that has met with commercial acceptance as a drawing compound in the automotive industry, as for example in stamping operations for automotive body parts. This comparative drawing compound contains a ground calcite pigment and emulsifier plus water in a mineral oil base.

After all panels are dried, they are placed in a condensing humidity test. In the condensing humidity test the water is heated and mechanically circulated with the water temperature being maintained at 140° F. The panels are placed in the cabinet at about a 15 degree angle to the water surface, the bottom edge of the panels being about 8" above the water surface and the top edge about 10" above the water surface. The back of the panels away from the water surface is exposed to the ambient air to permit condensation of the cabinet humidity on the test panel surface. In terminating the test, panels are simply removed from, the cabinet, dried, visually inspected and rated during such inspection, comparing panels one with the other, for the amount of red rust on the panel face.

After 17 hours of such testing, the panels coated with the drawing compound of the present invention showed 2.7% red rust, for an average of three panels, while those bearing the comparative drawing compound displayed 28% red rust, again for an average of three panels.

In further testing, primer coated test panels that are first lubricated, are subjected to shear testing. The panels are first precoated in the manner of the panels that are precoated in the discussion preceeding the Examples of U.S. Pat. No. 3,990,920. The compositions used are the pH adjusted compositions. The panels further have the primer top coating that has been discussed as an introduction to the examples in the aforesaid U.S. Pat. No. 3,990,920. Some test panels are then further prepared for testing by dipping in the lubricating composition of the present invention described hereinabove.

Panels are then tested in a draw test (shear adhesion) such as has been described in the U.S. Pat. No. 3,990,920. However, in the present test the clamp load or side pressure, is 2,800 pounds. Further, rather than the test panel being pulled through the die and bent around the radius of the ram as described in the aforesaid U.S. Pat. No. 3,990,920, the test panel is pulled at a 90° C. angle to the die. In such testing, the unlubricated panels show failure, sometimes by panel breakage, and other times by severe coating removal. On the other hand, the lubricated panels all show no breakage and display desirable coating retention whereby they are judged to pass the draw test.

We claim:

1. A lubricant composition particularly adapted for application to a primer coating on a metal substrate, which composition comprises a metallic stearate, emulsifier, titanium dioxide and Xanthomonas hydrophilic colloid, all in an aqueous medium.

2. The composition of claim 1 wherein said titanium dioxide component is supplied by pigmentary titanium dioxide having a particule size finer than about 200 mesh.

3. The composition of claim 1 wherein the metal of said metallic stearate is selected from the group consisting of calcium, zinc and mixtures thereof.

4. The composition of claim 1 wherein said emulsifier has an HLB number within the range from about 10 to about 12.

5. The composition of claim 1 further characterized by containing nonionic wetting agent.

6. The composition of claim 5 wherein said wetting agent is an alkoxylated alkyl phenol.

7. The composition of claim 1 further characterized by containing colloid preservative.

8. The composition of claim 1 further characterized by containing a substance providing corrosion resistance when applied to a metal substrate.

9. The composition of claim 8 wherein said substance is selected from the group consisting of nitrite salts, chromate salts, molybdates, vanadates, zinc and magnesium salts not specifically hereinbefore enumerated, and mixtures of the foregoing.

10. The composition of claim 1 wherein said Xanthomonas hydrophilic colloid in mixture, which mixture contains said colloid plus a water-soluble thickening polymer selected from the group consisting of natural gums, water-soluble cellulose esters, synthetic gums alginates, dextrins, starches, carageenan and mixtures thereof, and with the weight of said colloid being above about 60 weight percent of said mixture.

11. The composition of claim 1 further characterized as a concentrate, for subsequent dilution with aqueous medium, which concentrate comprises 1–25 weight percent metallic stearate, 0.5–12 weight percent emulsifier, 0.5–10 weight percent titanium dioxide, 0.2–2 weight percent of said colloid, and a balance of water.

12. The composition of claim 11 further characterized by being diluted with aqueous medium in a weight proportion of aqueous medium to concentrate within the range from about 2:1 to about 20:1.

13. A coated metal substrate having a coating providing coating protection to said substrate, said coating comprising a primer coat containing finely divided particulate substance, with said primer coat having an exposed surface film of lubricating composition comprising a metallic stearate, emulsifier, titanium dioxide and Xanthomonas hydrophilic colloid, all in aqueous medium.

14. The coated metal substrate of claim 13 wherein said primer coat is present in a thickness of at least about 0.1 ml and the lubricant film is present in wet condition.

15. The coated metal substrate of claim 13 wherein said primer coat is a weldable primer.

16. A process for deforming coated metal having a primer coat, while retarding coating loss during metal deformation, wherein said primer coat contains finely divided particulate substance, which process comprises, establishing on said primer coat a surface film of lubricating composition and then deforming said coated metal having resulting lubricated coating, wherein said lubricating composition comprises a metallic stearate, emulsifier, titanium dioxide and Xanthomonas hydrophilic colloid, all in aqueous medium.

* * * * *